US008123062B2

(12) United States Patent
Tontarelli

(10) Patent No.: US 8,123,062 B2
(45) Date of Patent: Feb. 28, 2012

(54) BOX WITH COLLAPSIBLE WALLS DESIGNED TO STACK A CORRESPONDING BOX WITH LOWER DIMENSIONS

(76) Inventor: Sergio Tontarelli, Castelfidardo (IT)

( * ) Notice: Subject to any disclaimer, the term of this patent is extended or adjusted under 35 U.S.C. 154(b) by 338 days.

(21) Appl. No.: 12/312,400

(22) PCT Filed: Nov. 20, 2007

(86) PCT No.: PCT/IT2007/000814

§ 371 (c)(1),
(2), (4) Date: May 7, 2009

(87) PCT Pub. No.: WO2008/062494

PCT Pub. Date: May 29, 2008

(65) Prior Publication Data

US 2009/0289059 A1 Nov. 26, 2009

(30) Foreign Application Priority Data

Nov. 22, 2006 (IT) ..... MC2006A0158
Aug. 13, 2007 (IT) ..... MC2007A0163

(51) Int. Cl.
*B65D 6/00* (2006.01)
*B65D 8/14* (2006.01)

(52) U.S. Cl. ..... 220/7; 220/6

(58) Field of Classification Search ..... 220/7, 480, 220/484, 6; 43/105
See application file for complete search history.

(56) References Cited

U.S. PATENT DOCUMENTS

| | | | | |
|---|---|---|---|---|
| 7,357,269 | B2 * | 4/2008 | Apps | 220/6 |
| 7,861,878 | B2 * | 1/2011 | Escarpa Gil | 220/7 |
| 2002/0108950 | A1 * | 8/2002 | Moorman et al. | 220/7 |
| 2006/0011627 | A1 * | 1/2006 | Overholt et al. | 220/7 |
| 2008/0142399 | A1 * | 6/2008 | Apps | 206/509 |

* cited by examiner

*Primary Examiner* — Mickey Yu
*Assistant Examiner* — Rafael Ortiz
(74) *Attorney, Agent, or Firm* — Lowe Hauptman Ham & Berner, LLP

(57) ABSTRACT

The present patent application relates to a plastic molded box with parallelepiped structure and rectangular base provided with collapsible walls, designed to stack a corresponding box with lower dimensions, it being provided with two oscillating shelves (5) on the internal side of the transversal walls (2) basically at the height of the opening.

1 Claim, 10 Drawing Sheets

10a
10b
a
11
8
8a
9
13a
13b
7a
7b 4a
4
5
7
2a
2

BOX WITH COLLAPSIBLE WALLS DESIGNED TO STACK A CORRESPONDING BOX WITH LOWER DIMENSIONS

The present patent application relates to a plastic moulded box with parallelepiped structure and rectangular base provided with collapsible walls, designed to stack a corresponding box with lower dimensions.

Boxes that can be stacked vertically have been device to save on space, in such a way that the bottom of the box can be partially engaged and supported in the upper opening of another box.

Vertical collapsible walls are normally provided in this type of parallelepiped boxes to optimise the use of space; reference is made to the walls hinged in the edges of the bottom wall of the box that is placed in vertical operative position or horizontal non-operative position against the bottom of the box (thus forming a sort of "packet").

Having verified the great practicality of such a solution, a new development was to provide similar vertical stacking of parallelepiped boxes with different bottoms.

It appears evident that, without a specific inventive solution, a box with lower dimensions would uncontrollably "fall" in the box with higher dimensions that is placed below it, thus preventing the ordered stacking of the boxes.

In particular, patent GB 2431922 discloses a box able to solve the aforementioned problem when stacking boxes with different dimensions provided with collapsible walls.

To that end, the top of each transversal wall of the box is provided with a special collapsible shelf that has basically the same length as the distance between the longitudinal walls of the box.

In particular, the said shelves are internally pivoted on the corresponding horizontal wall by means of arms preferably positioned in the proximity of the ends.

In this way, each shelf can alternatively switch from a (basically horizontal) projecting operative position towards the inside of the box, until the entire box is maintained in operative position, to a non-operative position in which it is placed against the internal side of the transversal wall, when the same is placed in horizontal position against the bottom of the box.

Evidently, when placed in operative position, the two shelves provide a good support for the bottom of a box with lower dimensions, thus preventing the latter from falling inside the opening of the larger box.

Moreover, the need to place each shelf in non-operative position against the internal side of the corresponding transversal wall is explained by the fact that otherwise the same wall could not be brought in perfect contact with the upper side of the bottom of the box (in its "collapsed" non-operative position).

This especially complicated prior technique provides for a solution to automatically change the position, from the operative to non-operative position, of the two shelves associated with the transversal walls of the box.

Considering that in all boxes with collapsible walls the transversal walls must be collapsed before the longitudinal walls, the solution adopted in the aforementioned British patent consists in the fact that the ends of each oscillating shelf are inserted inside corresponding grooves with curved profile obtained in the internal side of the longitudinal walls of the box.

As a matter of fact, while each transversal wall is rotated towards the bottom of the box, the ends of the oscillating shelf are forced to move along the curved grooves obtained in the internal side of the longitudinal walls.

This interference favours the gradual position change of each shelf, allowing it to rotate and switch from the initial position that projects with respect to the transversal wall to the final position at the end of the lower travel, in which the shelf is perfectly engaged against the internal side of the wall.

Of course, because of the cooperation between each shelf and the curved grooves, the shelf will make a rotation in inverse direction every time each transversal wall is raised, thus recovering the original operative position.

The specific purpose of the present invention is to simplify and optimise the construction of a box with collapsible walls provided with a pair of oscillating shelves designed to act in operative position as support for the bottom of another box with lower dimensions.

In this perspective, the main innovative peculiarity of the box of the invention consists in the easier construction of the oscillating shelves and in their automatic change from the operative to non-operative position.

In the new box of the invention, each shelf is hinged at the top of the corresponding transversal wall by means of a parallel series of arms that rotate according to a horizontal axis.

Until the wall is maintained in the vertical operative position, the shelf is spontaneously induced to maintain a horizontal position projecting on the internal side of the wall, exclusively because of its weight (and therefore because of gravity), since the barycentre is off-centred with respect to the horizontal pivoting axis.

When the transversal wall reaches a horizontal position after collapsing towards the bottom wall of the box of the invention, the shelf is subjected to the interference of two suitable profiles provided on the internal side of the longitudinal walls of the box that cause the 90° forward rotation with respect to the transversal wall.

Following to rotation the shelf is perfectly aligned with the top edge of the transversal wall, thus being contained inside the thickness of the said wall.

In this way, the shelf creates no impediment on the internal side of the transversal wall, which can be therefore perfectly engaged against the upper side of the bottom wall.

For purposes of clarity the description of the invention continues with reference to the enclosed drawings, which only have an illustrative, not limiting purpose, whereby:

Figure 1:
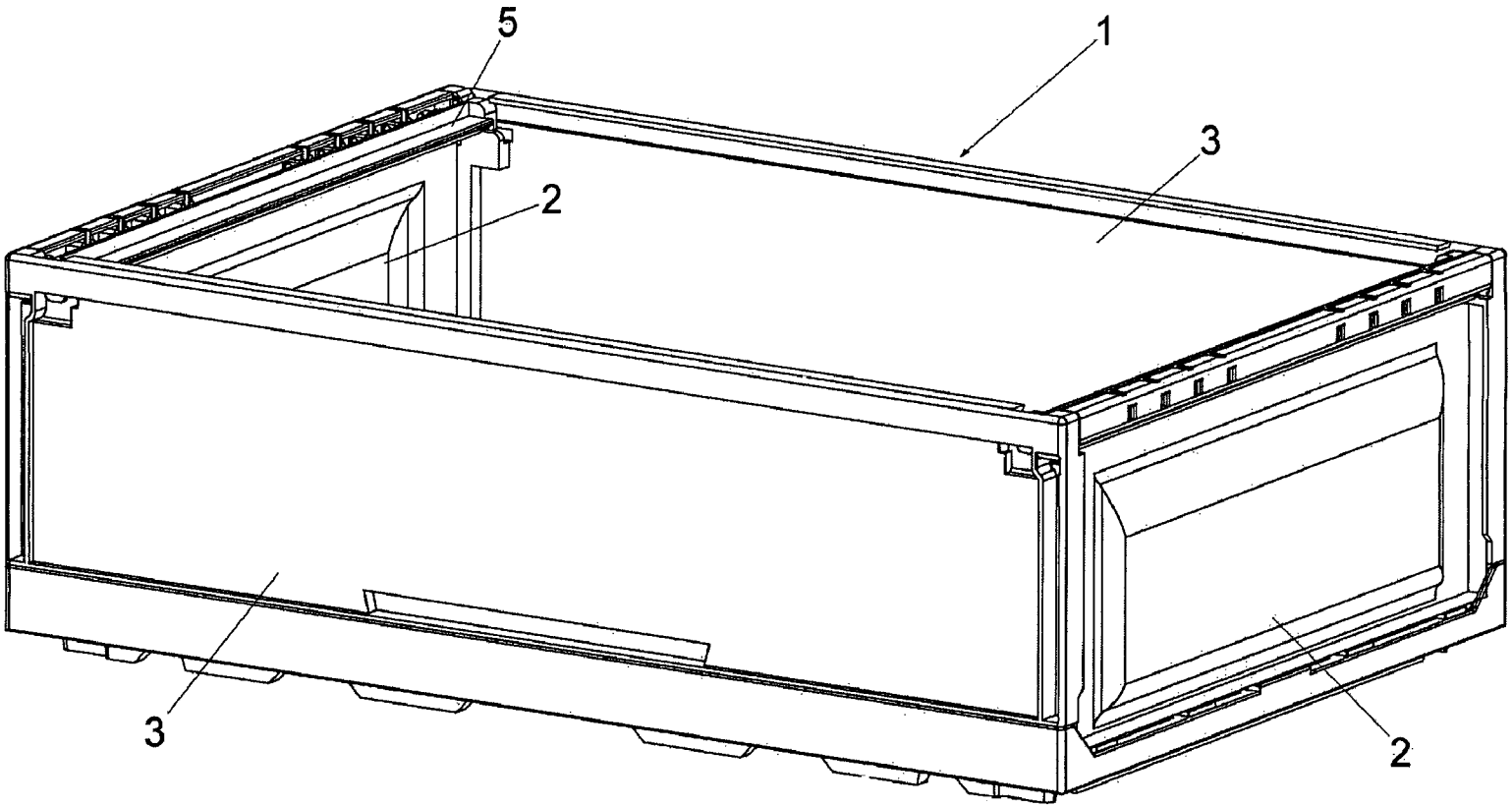
FIG. 1 is an axonometric view of the box of the invention.

With reference to the aforementioned figures, the plastic moulded parallelepiped box of the invention (1) is provided with collapsible walls (2, 3) hinged in lower position on the edges of the bottom (4).

In the said box a specific sequence of operations is usually adopted to collapse the walls, according to which the two transversal walls (2) and then the two longitudinal walls (3) are collapsed towards the bottom (4).

In such a consolidated configuration, the box of the invention (1) is characterised by the fact that each transversal wall (2) is provided in internal position on the top edge (2*a*) with a longitudinal shelf (5) pivoted by means of a parallel series of arms (6) that oscillate with respect to a horizontal axis parallel to the top edge (2*a*).

The internal side of the transversal wall (2), immediately under the top edge (2*a*) is provided with a rectilinear horizontal step (2*b*).

Each shelf (5) ends with edges (5*a*) from which corresponding catches (5*b*) project on a vertical plane parallel to the longitudinal walls (3).

A backward-facing horizontal wing (5*c*) is provided under the shelf (5) for its entire length.

Another peculiarity of the box of the invention (1) refers to the special configuration of the internal side of the longitudinal walls (3).

Figures 4, 4A, 4B:
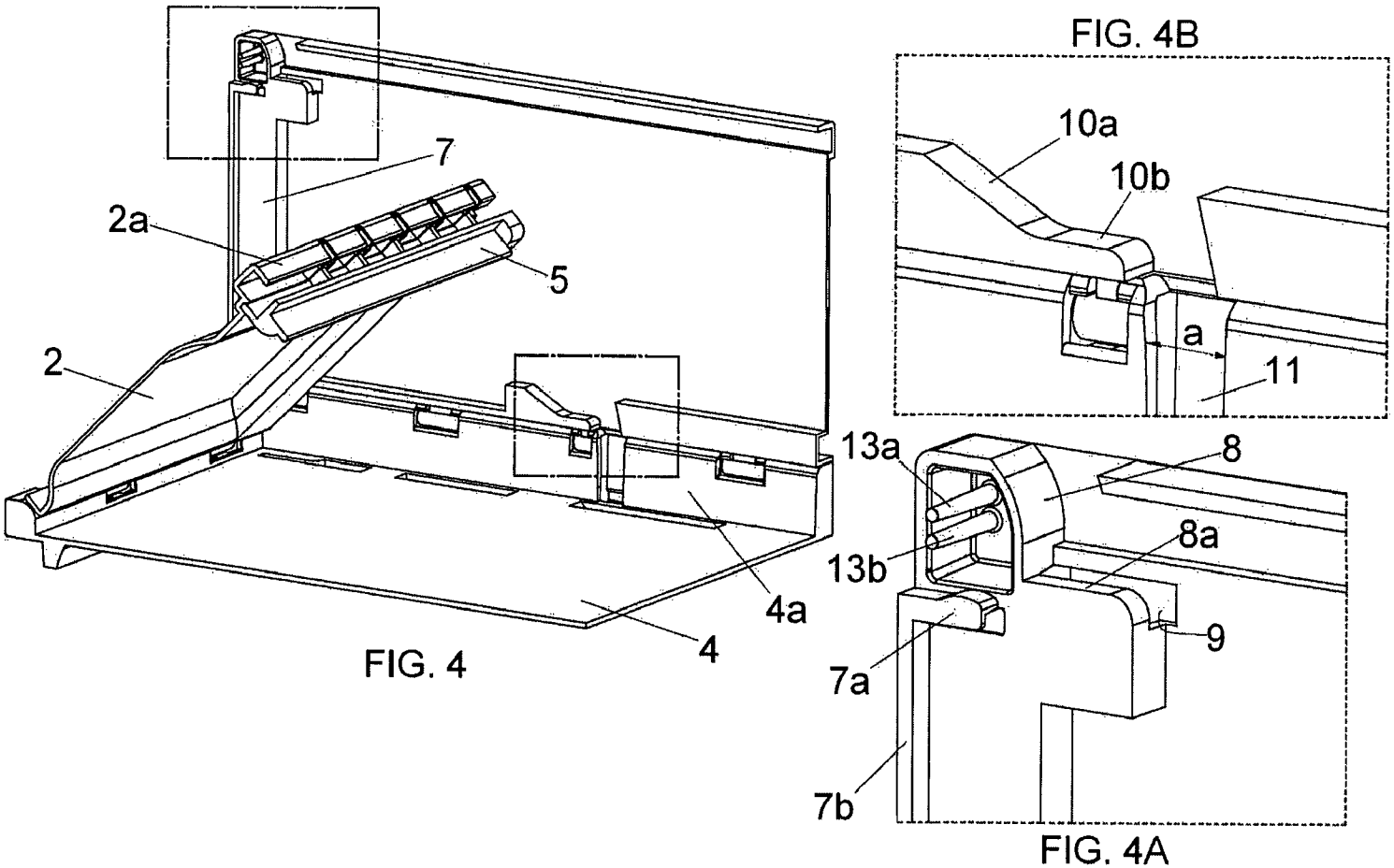

The internal side of the longitudinal walls (3) is provided at each end with a box-shaped beam (7) that ends with a L-shaped ridge (8) facing the inside of the box (1), with horizontal section (8*a*) provided with a narrow horizontal housing (9) bordered on the outside by the same internal side of the corresponding longitudinal wall 93), as shown in FIG. 4A.

The base of each longitudinal wall (3) is provided with two horizontal cams (10) in symmetrically opposite positions at a distance (d) basically equal to the height of the transversal walls (2) with respect to the vertical border of the wall (d).

Figure 7A:
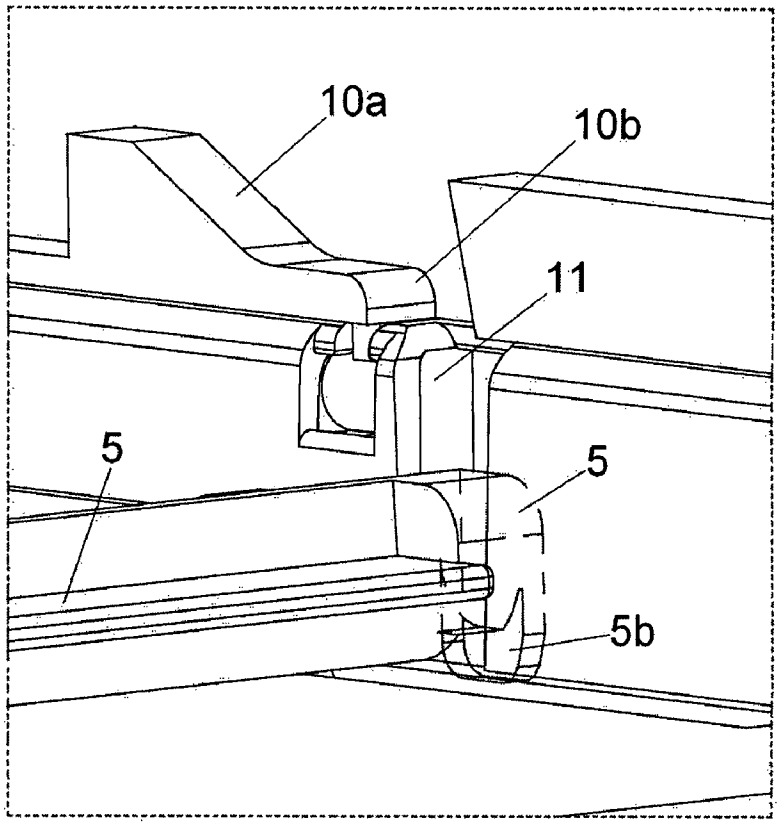

Each cam (10) is characterised by a first longer section (10*a*) with inclined profile from up downwards and ramp-configuration, and a second shorter section (10*b*), with lower height and rounded tip, as shown in FIG. 7A.

Each cam (10) is provided downstream with a rectilinear vertical groove (11) situated on the short vertical edge (4*a*) pivoted to each longitudinal wall (3), which has a slightly higher width (a) than the edges (5*a*) of the shelf (5).

Figures 2, 2A:
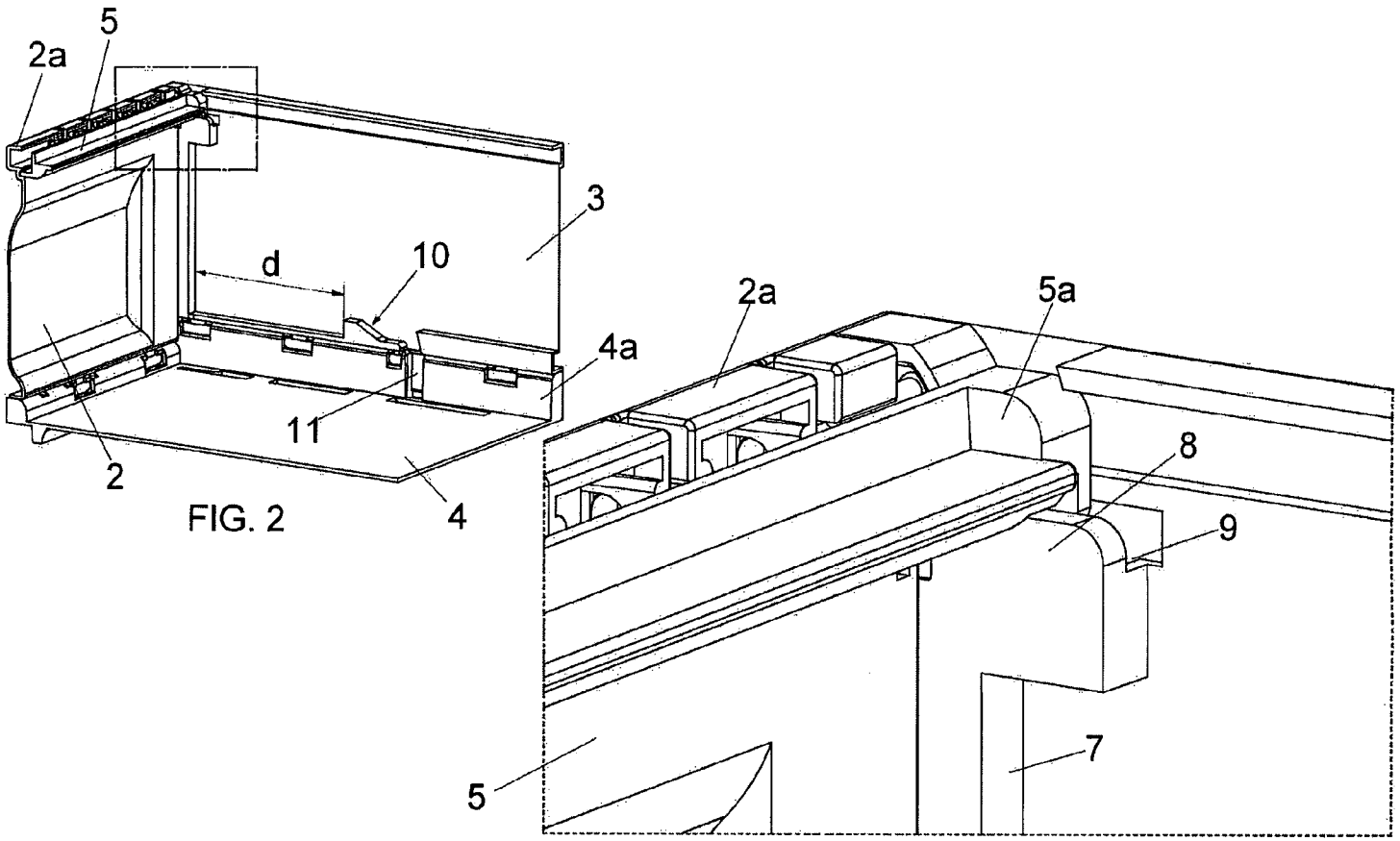
FIGS. 2 to 7 are partial axonometric views of the box of the invention that illustrate the different rotation steps from up downwards of one transversal wall of the box, with enlarged details.

This description continues by illustrating the operational modes of the box of the invention (1), starting from the configuration in operative position, that is to say with the four walls (2, 3) in vertical position, as shown in FIG. 2.

In this situation the shelf (5) associated with each transversal wall (2) tends to have a horizontal position, protruding towards the inside of the box (1), in view of the weight and gravity, thus becoming a useful support for the bottom of another box with lower dimensions.

In order to stabilise the position of the shelf (5) and ensure suitable resistance to weight, each ending edge (5*a*) is perfectly coupled above the corresponding horizontal section (8*a*) of the L-shaped ridge (8).

At the same time the catch (5*b*) that protrudes from the bottom of each edge (5*a*) of the shelf (5) is exactly engaged in the housing (9) obtained in the horizontal section (8*a*) of the ridge (8) provided on the longitudinal wall (3).

Figure 10:
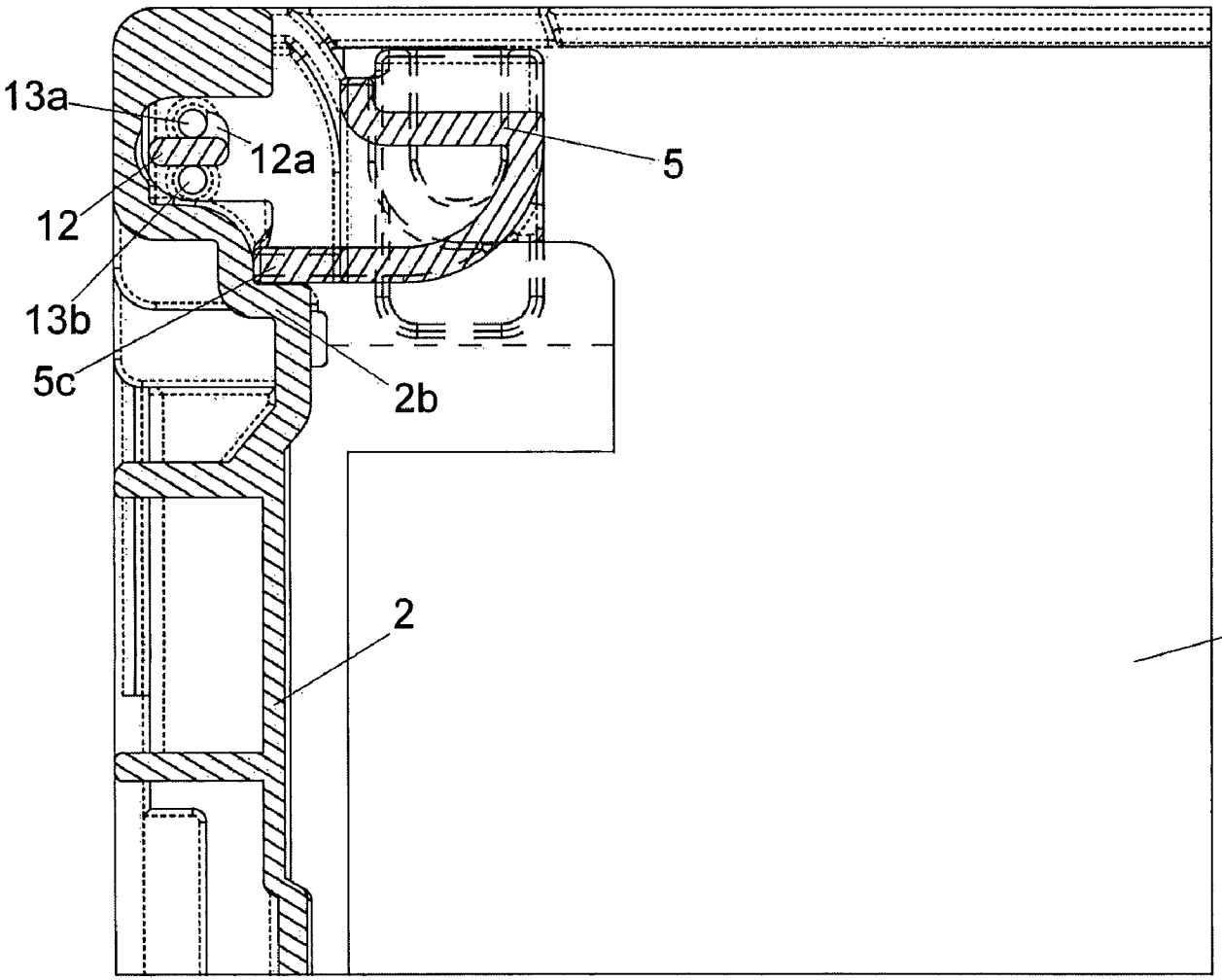
FIG. 10 is a cross-sectional view of FIG. 8 with a vertical plane parallel to the longitudinal walls of the box.

Finally, the horizontal wing (5*c*) provided in back lower position on the shelf (5) is exactly supported above the step (2*b*) provided in the internal side of the transversal wall (2), immediately below the top edge (2*a*) of the same wall, as shown in FIG. 10.

Considering that each lateral catch (5*b*) is an integral part of the shelf (5) and corresponding transversal wall (2), it is evident that the exact insertion inside the corresponding housing (9) prevents the four walls (2, 3) of the box (1) from accidentally uncoupling until the box maintains the vertical operative position.

More precisely, this prevents the two longitudinal walls (3) from uncontrollably overturning outwards with respect to the transversal walls (2) in vertical position.

In order to avoid the uncontrolled collapsing towards the inside of each transversal wall (2) with respect to the longitudinal walls (3) in vertical position, each ridge (8) of the two longitudinal walls (3) is provided in lower position with a tooth (7*a*) designed to elastically snap into a corresponding housing provided on the vertical border of the transversal wall (2).

The aforementioned tooth (7*a*) is joined in lower position with a rib (7*b*) obtained in the external corner of the beam (7) designed to act as stop limit for the transversal wall 92) during the ascending travel.

Figure 3A:
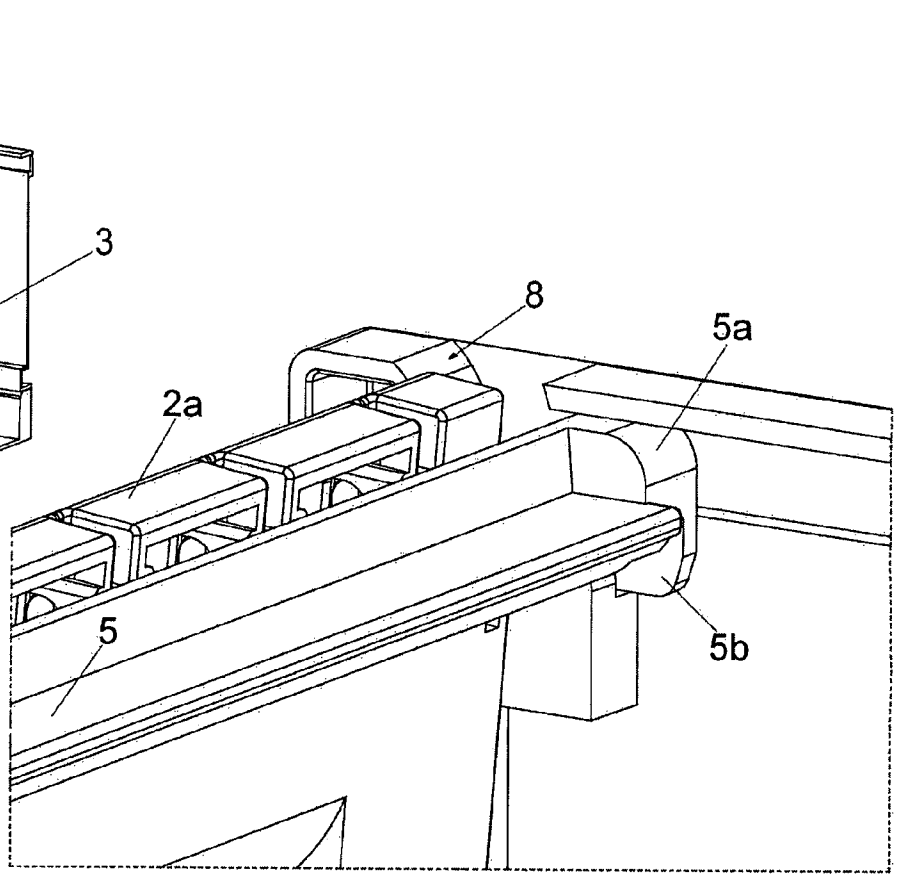
Figure 3:
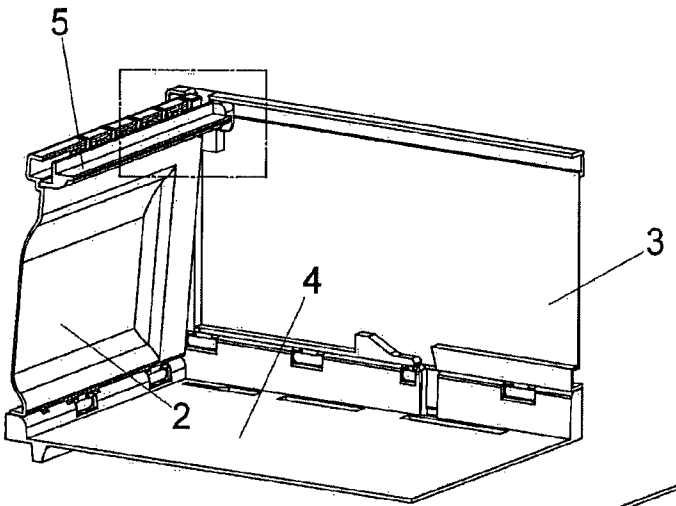

The box (1) is compacted according to a traditional sequence of operations, in which the transversal walls (2) are rotated towards the bottom (4) before the longitudinal walls (3), as shown starting from FIG. 3.

In such a circumstance, a force must be exerted on each transversal wall (2) from the outside towards the inside to release the two lateral catches (5*b*) of the shelf (5) from their housing (9).

Further to the additional rotation of the said wall (2) towards the bottom (4), a simultaneous interference of the two lateral catches (5*b*) of the shelf (5) is generated against the cams (10) provided in opposite position at the base of the longitudinal walls (3).

Figure 5A:
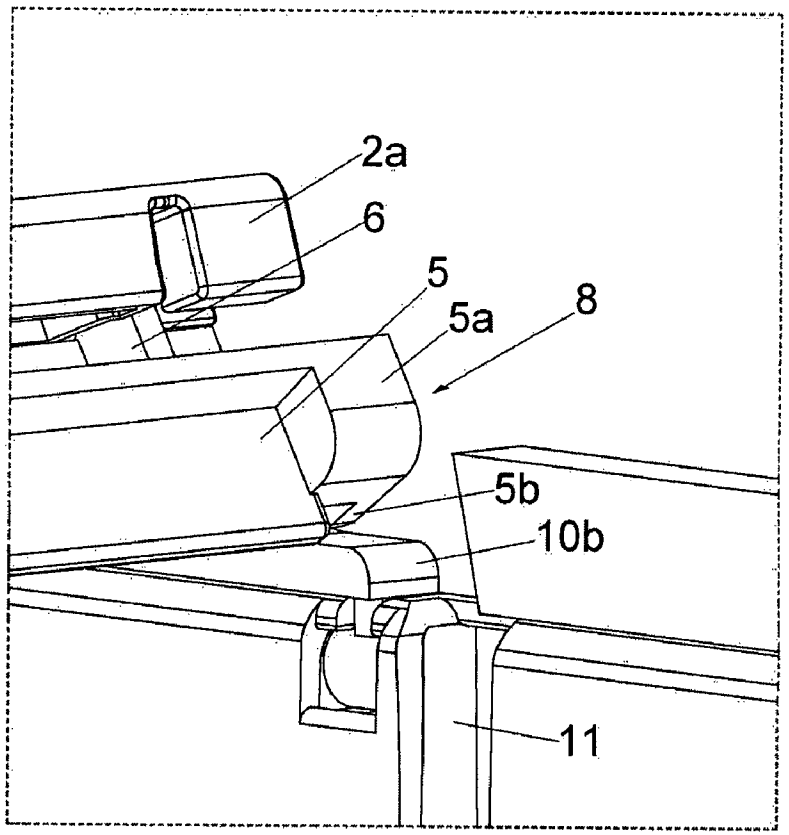
Figure 5:
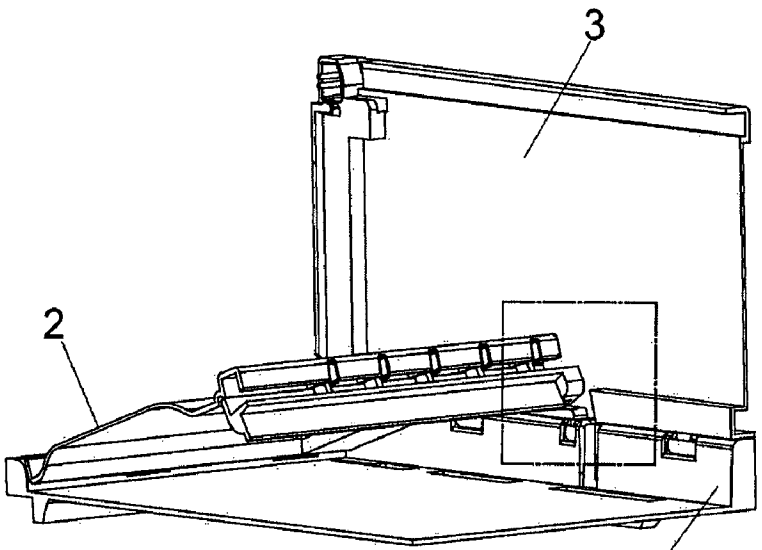
Figure 6A:
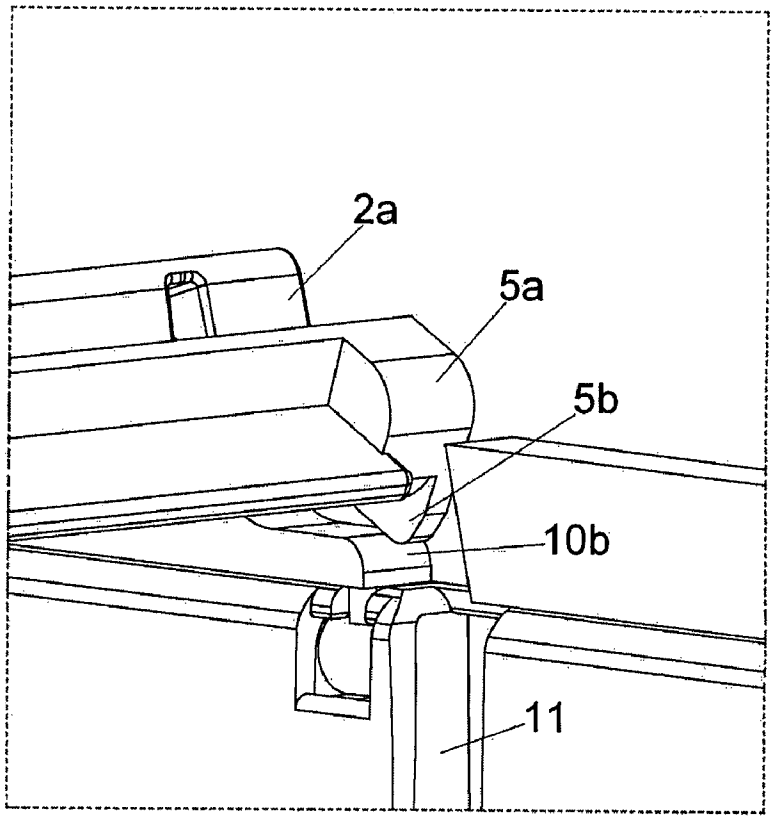
Figure 6:
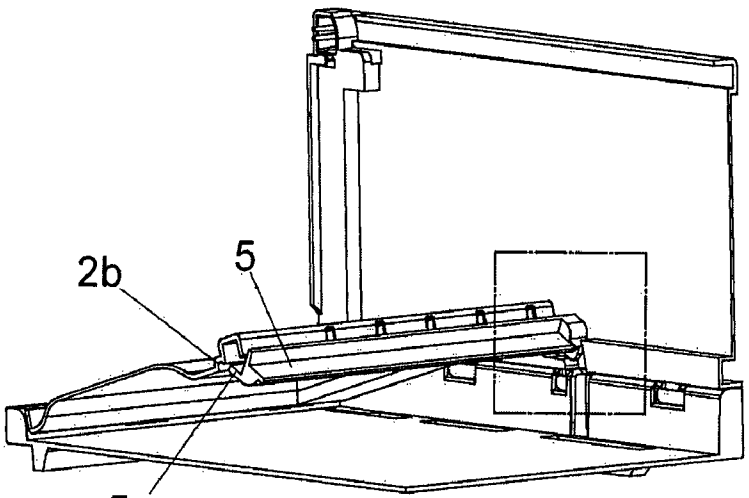

With reference to FIGS. 5 and 6, the gradual interference of the catches (5*b*) with the inclined section (10*a*) and then with the rounded tip of the shorter section (10*b*) of the two cams (10) generates an approximately 90° rotation from down upwards of the shelf (5), reaching a perfectly coplanar position with respect to the transversal wall (2).

Figure 7:
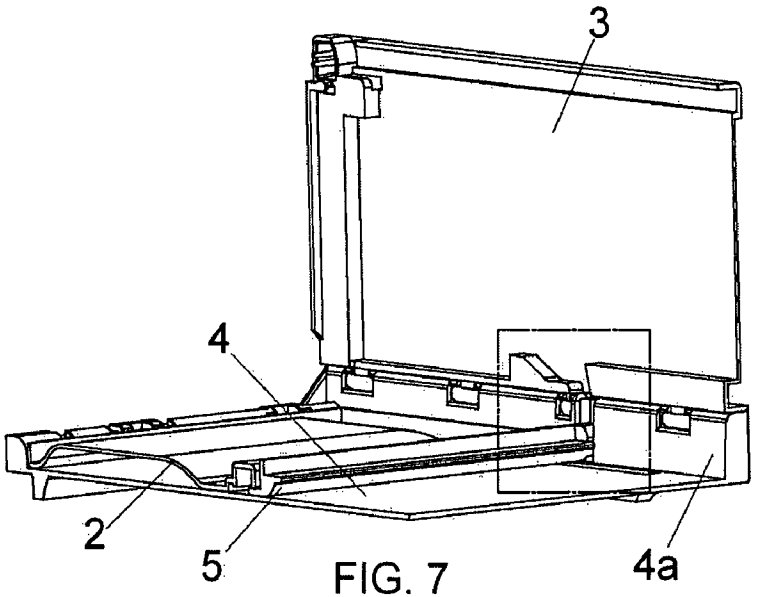

By continuing the rotation of the transversal wall (2) downwards, the two edges (5*a*) of each shelf (5) penetrate until the end of the said vertical grooves (11) provided in internal position on the hinging edges (4*a*) of the two longitudinal walls (3), as shown in FIG. 7.

This condition ensures that each transversal wall (2) of the box (1) is perfectly engaged, without interferences, against the upper surface of the bottom (4).

To bring the box of the invention (1) back to the operative position, the longitudinal walls (3) and then the transversal walls (2) must be raised again.

It must be noted that the traction force exerted on each transversal wall (2) must be such to favour the uncoupling of the edges (5*a*) of the shelf (5) from the grooves (11).

While the wall (2) is rotated upwards, because of its own weight, the shelf (5) tends to fall downwards and return in the projecting position towards the inside of the box (1) when the inference with the opposite cams (10) ends.

When the wall (2) is raised, the shelf (5) is in perfectly horizontal position, in which the lateral catches (5*b*) are reintroduced inside the housings (9) provided on opposite parts on the internal side of the two longitudinal walls (3).

It must be noted that the presence of the two shelves (5) in the operative position could hinder the loading and unloading of goods in the box (1).

In this situation it would be convenient to overturn the two shelves (5) upwards to completely free the opening of the box (1) in the operative position.

In order to automatically bring the shelves (5) in their operative horizontal position, at the end of the said loading and unloading operations, the box of the invention (1) is provided with suitable elastic return means.

With reference to FIGS. 8 to 11, the elastic return is produced by the cooperation of shaped partitions (12) obtained during moulding with the shelf (5) and a pair of elastically flexible cylindrical pegs (13*a* and 13*b*) that protrude horizontally on the inside of the ridges (8) of the longitudinal walls (3).

In particular, the partitions (12) of each shelf (5) are situated at the two ends of the shelf (5) and aligned with the rotation axis of the shelf (5).

Each partition (12) is provided with a sort of beak (12*a*) designed to interfere with the opposite pair of cylindrical pegs (13*a* and 13*b*) in such a way that it exactly receives the partition (12) when the shelf (5) is in operative position.

Figure 8:
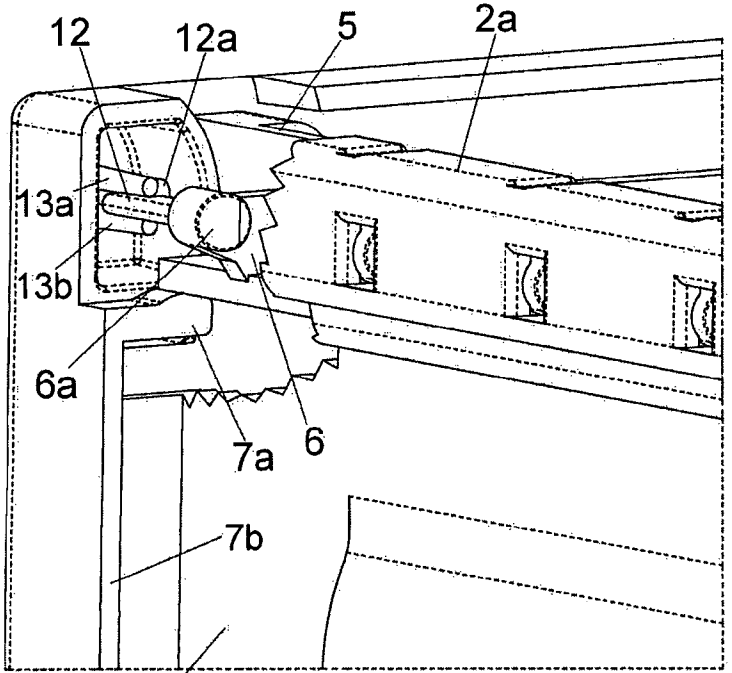
FIG. 8 is an enlarged view that shows the coupling of each shelf with corresponding elastic return means in operative position.

As shown in FIGS. 8 and 10, in this position the beak (12*a*) adheres to the upper peg (13*a*) without pressure.

Figure 9:
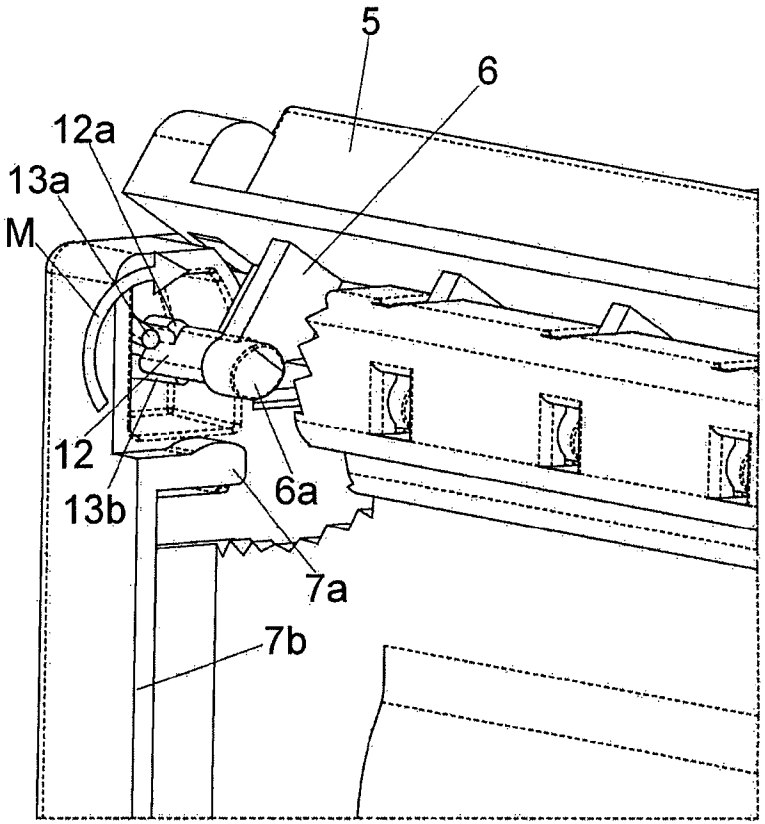
FIG. 9 is the same as FIG. 8, except for the fact that the shelf is rotated upwards.
Figure 11:
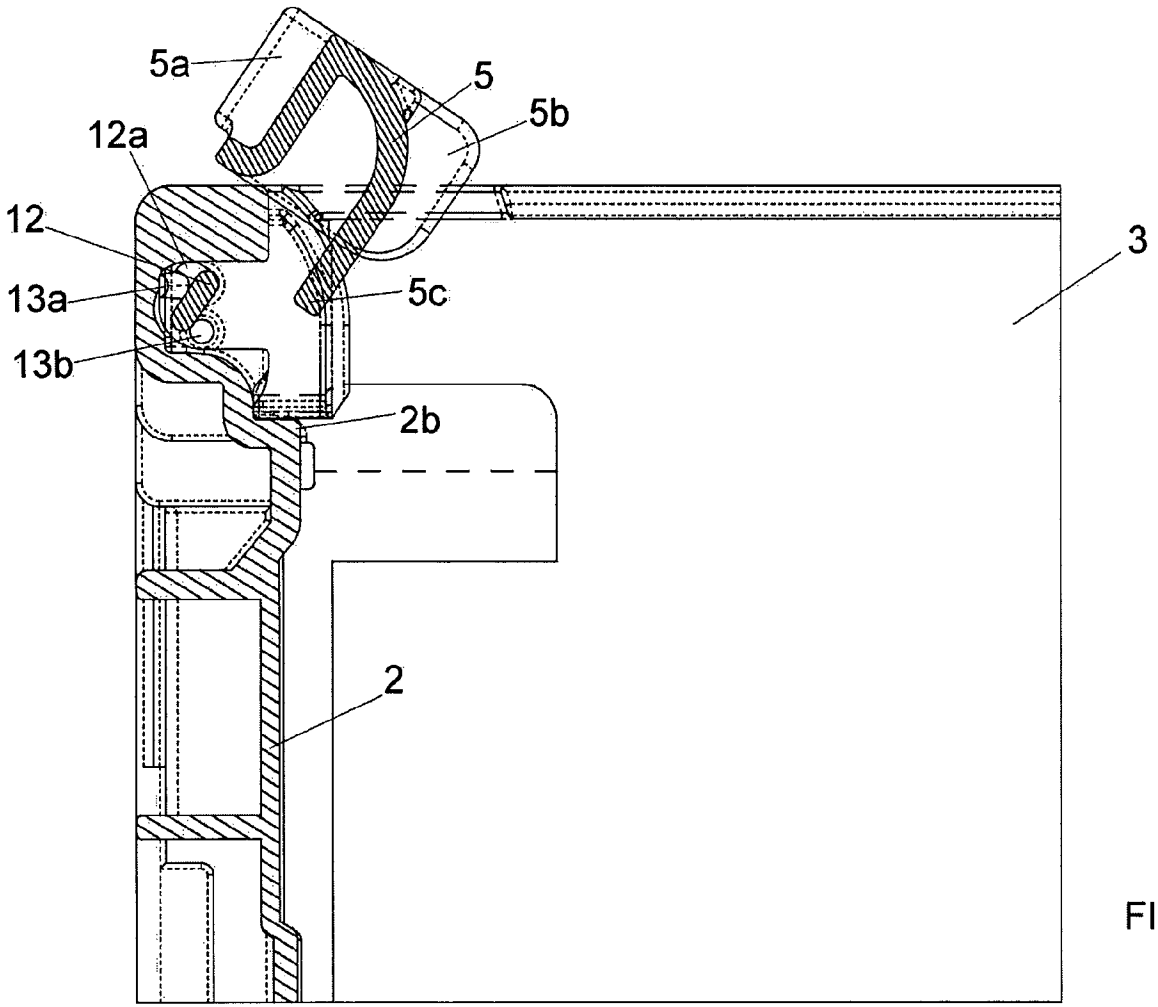
FIG. 11 is a cross-sectional view of FIG. 9 with a vertical plane parallel to the longitudinal walls of the box.

When the shelf (5) is rotated upwards, with the wall (2) in vertical position, the beak (12*a*) interferes with the upper peg (13*a*) with elastic flexion, as shown in FIGS. 9 and 11, and generates by reaction the return overturning momentum (M) shown by the arrow in FIG. 9, which always tends to bring the shelf (5) back in horizontal position.

As shown in FIGS. 8 to 11, numeral (6*a*) indicates the pins obtained during moulding on the back of the arms (6) of the shelf (5) designed to elastically snap in corresponding pivoting housings obtained on the top edge (2*a*) of the transversal walls (2).

The invention claimed is:

1. Plastic molded box with a bottom (4), collapsible transversal walls (2) and collapsible longitudinal walls (3); a collapsible shelf (5) provided on an internal side on a top of each transversal wall, the transversal wall being provided inversely rotated with respect to the bottom (4) wherein the collapsible shelf (5) is brought from an operative position that protrudes on the inside of the box (1) to a non-operative position in which no impediment is generated between the internal side of the transversal wall and an upper side of the bottom (4) characterized in that the collapsible shelf (5) having opposite ends (5*a*) and a back is hinged to a top edge (22) of the transversal wall (2) by a pivoting means (6, 6*a*) that allows the shelf to be placed in a horizontal position by gravity when the transversal wall (2) is maintained in a vertical operative condition, an internal side of each of the two longitudinal walls (3) is provided with symmetrically opposite means (10) designed to interfere, near the ends of the transversal wall (2) towards the non-operative horizontal position, with the ends (5*a*) of the collapsible shelf (5), thus imposing a forward rotation of approximately 90° on the collapsible shelf (5), the collapsible shelf (5) reaching a coplanar position with the transversal wall (2), the means (6, 6*a*) used to pivot the collapsible shelf (5) on the top edge (2*a*) of each transversal wall (2) consisting of a parallel series of arms (6) ending with corresponding pins (6*a*) that oscillate with respect to a horizontal axis parallel to the top edge (2*a*) of the transversal wall (2), the collapsible shelf (5) being brought in operative position after an upward ascending travel with the box (1) in a vertical operative position by cooperating elastic means (12), said cooperating elastic means comprising a partition situated at the two ends of the collapsible shelf (5) and aligned with the rotation axis of the collapsible shelf (5); each partition (12) is provided with a beak (12*a*) designed to interfere with opposite pair of flexible pegs (13*a*, 13*b*) protruding horizontally from the longitudinal walls (3).

* * * * *